United States Patent [19]

Anderson

[11] Patent Number: 4,717,862

[45] Date of Patent: Jan. 5, 1988

[54] PULSED ILLUMINATION PROJECTOR

[75] Inventor: William B. Anderson, Port Ludlow, Wash.

[73] Assignee: The United States Government as represented by the Secretary of the Navy, Washington, D.C.

[21] Appl. No.: 672,728

[22] Filed: Nov. 19, 1984

[51] Int. Cl.[4] ..... H05B 41/16

[52] U.S. Cl. ..... 315/246; 315/241.5; 315/307; 315/271; 315/247; 356/438; 367/13

[58] Field of Search ..... 315/307, 241 S, 149, 315/150, 271, 247, 246, 287; 356/438; 367/13

[56] References Cited

U.S. PATENT DOCUMENTS

| | | | |
|---|---|---|---|
| 2,936,387 | 5/1960 | Steele et al. | 315/241 S |
| 4,170,747 | 10/1979 | Holmes | 315/307 |
| 4,187,488 | 2/1980 | Anderson et al. | 367/13 |
| 4,225,227 | 9/1980 | Seitz | 315/241 S |
| 4,253,046 | 2/1981 | Gerhard et al. | 315/307 |
| 4,464,606 | 8/1984 | Kane | 315/307 |
| 4,498,031 | 2/1985 | Stupp et al. | 315/307 |
| 4,499,525 | 1/1985 | Mallory | 315/307 |

*Primary Examiner*—Leo H. Boudreau
*Assistant Examiner*—Michael Razavi
*Attorney, Agent, or Firm*—R. F. Beers; C. D. B. Curry

[57] ABSTRACT

A pulsed illuminator projector for reducing the reverberation levels of reflected ligh by illuminating a lamp that is pulsed on and off at a specified rate and for a specified time duration. The critical factor is controlling the amount of time the light is on versus amount of time it is off, and the frequency at which the lamp is pulsed on. The pulsed illumination projector device reduces the amount of backscatter from particulate matter such as water, zooplankton, dust, fog and the like which causes a significant amount of light to reflect back toward the source thereby reducing visibility. Backscatter is reduced through the reduction of direct incident light. As the backscatter is reduced, the distance which objects can be detected is increased. Illumination is controlled directly by pulse length and repetition rate. The device is completely portable and can be hand held item as well as mounted on a vehicle and operable in gaseous or liquid atmospheres.

6 Claims, 2 Drawing Figures

PULSED ILLUMINATION PROJECTOR

BACKGROUND OF THE INVENTION

1. Field of the Invention

This invention relates to a pulsed illumination projector and more particularly to a pulse illumination projector that provides for better visibility by reducing the effect of luminous reverberation backscatter.

2. Description of the Prior Art

It is frequently necessary to determine the location of objects located in a media surrounded by suspended particulate matter similar to particulate water droplets of fog in the air or sediment matter suspended in water. The luminous reverberation causes excessive amounts of light in the search beam to be reflected back to the source. As the intensity of reflected light is increased it reduces the ability to perceive objects which reflect less light than the surrounding particulate matter which is causing light to be reflected in a like manner. The light which is reflected from the surrounding matter is referred to as luminous reverberation. Traditional methods for achieving this have been by the use of constant illumination by means of lights having different levels of intensity and being in different color spectrums. The disadvantage of these prior techniques is that they have been unable to effectively reduce luminous reverberation backscatter from particulate matter suspended in the illuminated medium.

SUMMARY OF THE INVENTION

It is an object of the present invention to provide a pulsed illumination projector that provides better visibility by reducing the luminous reverberation backscatter.

Another object of the present invention is to provide a technique for improving underwater visibility.

Still another object of the present invention is to provide an inexpensive, reliable, portable and simple apparatus for improved illumination visibility.

These and other objects are accomplished by reducing the reverberation levels of reflected light by illuminating a lamp that is pulsed on and off at a specified rate and for a specified time duration. The critical factor is controlling the amount of time the light is on versus amount of time it is off, and the frequency at which the lamp is pulsed on. The pulsed illumination projector device reduces the amount of backscatter from particulate matter such as water, zooplankton, dust, fog and the like which causes a significant amount of light to reflect back toward the source thereby reducing visibility. Backscatter is reduced through the reduction of direct incident light. As the backscatter is reduced, the distance which objects can be detected is increased. Illumination is controlled directly by pulse length and repetition rate. The device is completely portable and can be a hand held item as well as mounted on a vehicle and operable in gaseous or liquid atmospheres.

Other advantages and features will become apparent from the following description of the preferred embodiment when considered in conjunction with the accompanying drawings wherein:

DESCRIPTION OF THE PREFERRED EMBODIMENT

Figure 1:
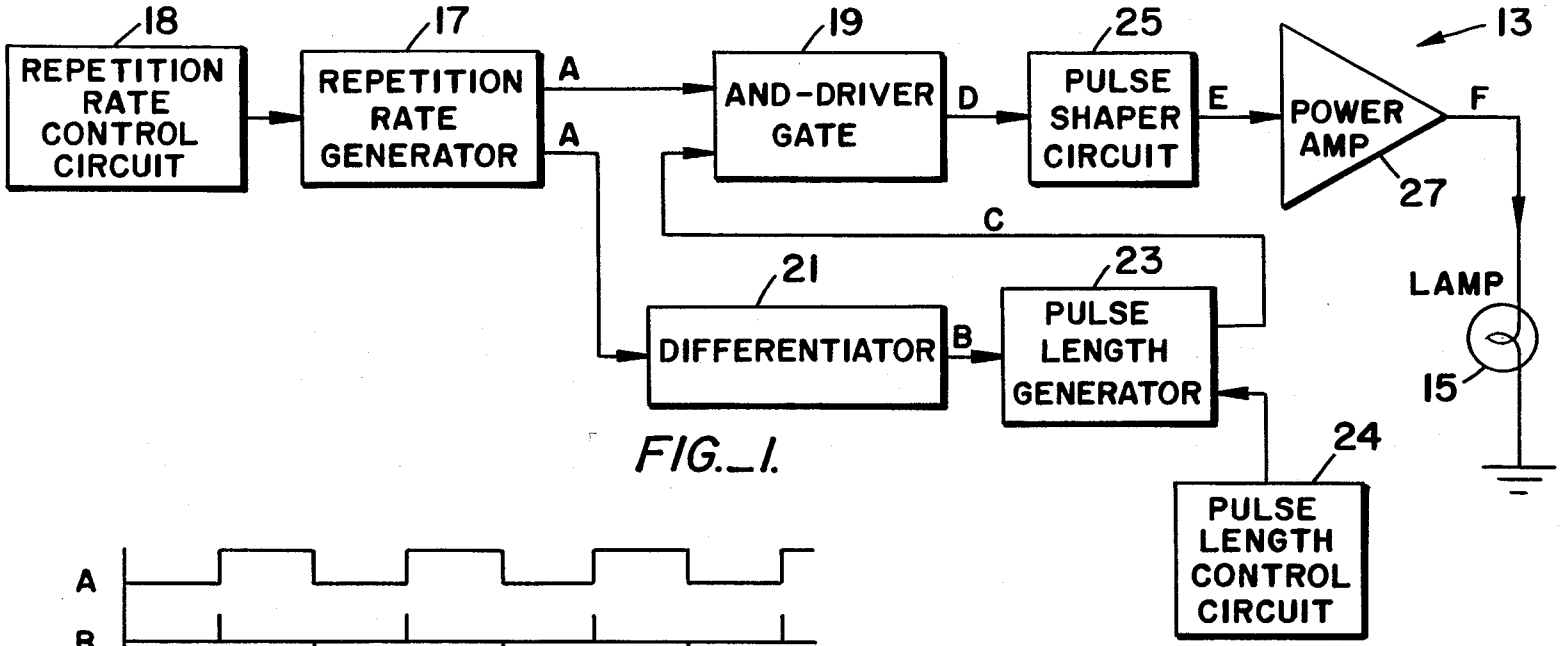
FIG. 1 is a block diagram of the pulsed illumination projector of the present invention.
Figure 2:
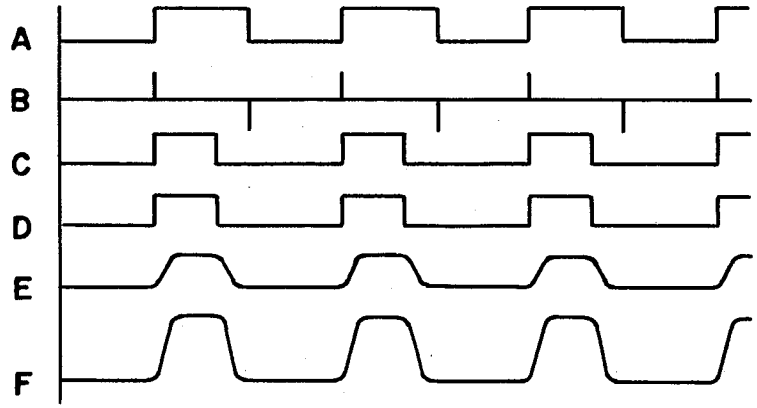
FIG. 2 is a timing and control signal diagram illustrating the operation of the FIG. 1 system.

In FIG. 1 is shown a block diagram of the pulsed illumination projector 11 of the present invention. The projector 11 includes the pulse forming electronic control circuit 13 and the lamp 15. The electronic circuit 13 controls the repetition rate and the pulse length of the electrical signal applied to the terminals of lamp 15. Control of the pulse repetition rate and the pulse length reduce the reverberation to an acceptable level and thereby enhance the location of objects in an otherwise adverse environment. The control circuit 13 includes repetition rate generator 17, repetition rate control circuit 18, AND-gate driver 19, differentiator 21, pulse length generator 23, pulse length control circuit 24 pulse shaper circuit 25 and power amplifier 27. The repetition race generator 17 is an adjustable free running multi-vibrator which is used to control the frequency at which the lamp is illuminated or extinguished. The output signal A of the repetition rate generator 17 may be varied by the voltage level of repetition rate control circuit 18. The output of generator 17 is outputted to a logic AND-driver gate 19 and a differentiator 21. The differentiator 21 generates a signal B that has a positive going pulse on the leading edge of a signal A and a negative pulse on the tailing edge of signal A. The positive trigger pulse initiates the pulse length generator 23. The pulse length generator 23 controls the period the voltage is applied to the illuminating lamp. The duration of the pulse length generator 23 is adjustable by the voltage level of pulse length control device 24. The pulse length generator output voltage C which, when present at the AND-driver gate with the signal A, of the repetition rate generator 17 will hold the AND-driver gate 19 on as long as both signals are present. The AND-driver gate 19 applies a signal D to the pulse shaper circuit 25. The pulse shaper 25 will increase both the rise and fall time of the pulse and thereby protect the lamps illuminating elements from rise time shock. The pulse shaper output E is fed into the power amplifier 27 which drives the lamp 15 with proper voltage F amplitude at the predetermined pulse length and rate. The amplifier feeds either alternating current voltage or direct current voltage to the lamps as well as high voltage for gas discharge lamps.

The pulsed illumination projector of the present invention is a portable lighting source designed for specific operation in an environment in which particulate scatterers exist. The lamp can reduce the amount of backscatter, thereby increasing the distance of vision in the difficult environment.

The following parameters have been found to be suitable for practice of the present invention:

Repetition Rate (A) range—0.5–5 pulses per second

Pulse Length (C) range—1–1000$\mu$ seconds

The selection of particular values of repetition rate A and pulse length C depend upon the particular reverberation backscatter environment and may be adjusted by circuits 18 and 24 on site or preadjusted as taught by empirical data and as theoretically discussed with respect to the underwater acoustic reverberation backscatter system of U.S. Pat. No. 4,187,488 dated Feb. 5, 1980 by William B. Anderson.

What is claimed is:

1. A method for providing improved illumination visibility in an illuminated medium having particulate matter suspended therein by reducing luminous reverberation backscatter from said particulate matter which comprises:

(a) providing illumination in a series of light pulses; and (b) adjusting the pulse length and pulse repetition rate of said light pulses during operation to minimize the luminous reverbation backscatter.

2. A method as recited in claim 1 wherein said step of providing illumination in a series of light pulses includes providing illumination in a series of light pulses having an adjustable pulse repetition rate of between 0.5 pulses per second and 5 pulses per second and an adjustable pulse length of between 1000 microseconds and 1 second.

3. Apparatus for providing improved illumination visibility in an illuminated medium having particulate matter suspended therein by reducing luminous reverberation backscatter from said particulate matter, which comprises:

(a) a lamp for providing illumination; and (b) control means for energizing said lamp to provide illumination in a series of light pulses, (c) said control means having means for selecting the pulse repetition rate of said light pulses, (d) said control means having means for selecting the pulse length of said light pulses, said pulse repetition rate and pulse length being adjustable during operation to reduce reverberation backscatter.

4. Apparatus as recited in claim 3 wherein said control means for energizing said lamp to provide illumination in a series of light pulses includes means of energizing said lamp to provide illumination in a series of light pulses having a pulse repetition rate range of between 0.5 pulses per second and 5 pulses per second and a pulse length range of between 1000 microseconds and 1 second.

5. Apparatus as recited in claim 4 wherein said control means includes:

(a) a pulse repetition rate generator for providing a series of first pulses at the desired pulse repetition rate;

(b) a differentiator coupled to receive said series of first pulses, said differentiator generating a second pulse at the beginning of each first pulse to provide a series of second pulses;

(c) a pulse length generator coupled to receive said second pulses from said differentiator, said pulse length generator producing a series of third pulses having the desired pulse length;

(d) an AND circuit coupled to receive said first pulses from said pulse repetition rate generator and said second pulses from said pulse length generator, said AND circuit providing a series of fourth pulses having the desired pulse repetition rate and the desired pulse length, said series of fourth pulses being coupled to drive said lamp to provide illumination in a series of light pulses at the desired pulse repetition rate and pulse length.

6. Apparatus as recited in claim 5 wherein said control means further includes means for adjusting the pulse repetition rate of said first pulses from said pulse repetition rate generator and means for adjusting the pulse length of said third pulses from said pulse length generator.

* * * * *